US008105106B1

(12) United States Patent
Stoddard

(10) Patent No.: US 8,105,106 B1
(45) Date of Patent: Jan. 31, 2012

(54) DISPOSABLE ILLUMINATED ELECTRICAL PLUG ADAPTER

(76) Inventor: James Marshall Stoddard, Craig, CO (US)

( * ) Notice: Subject to any disclaimer, the term of this patent is extended or adjusted under 35 U.S.C. 154(b) by 404 days.

(21) Appl. No.: 11/811,331

(22) Filed: Jun. 8, 2007

Related U.S. Application Data

(60) Provisional application No. 60/812,558, filed on Jun. 10, 2006.

(51) Int. Cl.
*H01R 3/00* (2006.01)

(52) U.S. Cl. ..... 439/490; 362/95

(58) Field of Classification Search ..... 439/107, 439/490; 362/95, 114, 119, 190, 629
See application file for complete search history.

(56) References Cited

U.S. PATENT DOCUMENTS

| | | | | |
|---|---|---|---|---|
| 3,382,355 | A * | 5/1968 | Prifogle et al. | 362/641 |
| 5,007,857 | A * | 4/1991 | Wright | 439/490 |
| 6,290,533 | B1 | 9/2001 | Major | |
| 7,004,595 | B1 | 2/2006 | Stoddard | |
| 7,036,948 | B1 * | 5/2006 | Wyatt | 362/95 |
| 7,220,136 | B1 * | 5/2007 | Green | 439/106 |
| 7,490,958 | B1 * | 2/2009 | Stoddard | 362/253 |

* cited by examiner

*Primary Examiner* — Thanh Tam Le

(57) ABSTRACT

A disposable, non servicable, illuminating electrical adapter (205) that quickly illuminates and attaches to a conventional electrical plug (285) and functions to illuminate both an electrical receptacle 220 and the adapter face itself for the purpose of locating and safely inserting electrical adapter between electrical plug and an electrical receptacle. Additional features include opaque 255 and translucent 260 image applications that enable the adapter 205 to function as a combination promotional/awareness generating product and also a safety promoting, useful tool.

5 Claims, 5 Drawing Sheets

DISPOSABLE ILLUMINATED ELECTRICAL PLUG ADAPTER

CROSS-REFERENCE TO RELATED INVENTIONS

This application claims the benefit of U.S. Pat. No. 7,004,595B1 to Stoddard and Provisional Patent Application No. 60/812,558 file Jun. 10, 2006 to Stoddard and Provisional patent application Ser. No. 11/354,330 to Stoddard

FEDERALLY SPONSORED RESEARCH

Not Applicable

SEQUENCE LISTING OR PROGRAM

Not Applicable

BACKGROUND OF THE INVENTION

1. Field of Invention

This invention relates to disposable electrical adapters of all types and voltages, including 120 V.A.C. plug adapters, all equipped in some capacity with light emitting diodes and power sources used to illuminate receptacles for the purpose of safe receptacle recognition and connection.

2. Background of the Invention

Presently existing electrical plugs are very common and vital components providing a convenient and safe way to quickly provide electrical connection to electrical devices.

There are situations where plugging a device into a receptacle can be somewhat difficult; one such example is attempting to align a plug to an electrical outlet where the view of the outlet is obscured by darkness.

U.S. Pat. No. 6,290,533 (2001) to Major discloses a flashlight plug which is an illuminated, 110 v.a.c., male, electrical plug & cord assembly designed to illuminate an electrical outlet while a user is in the process of inserting the plug into the receptacle. Drawbacks to this device include: disclosed in the form of a plug/cord, it cannot be used on existing devices without replacing the original electrical cord. Considering the vast difference of electrical cord designs, including mounting, strain relief, amperage ratings, and differences of electrical attachment found on electrical appliance power cords, providing this plug/cord with a safe and suitable universal design could become a very daunting and expensive proposal. Incorrect installation of the Flashlight Plug as disclosed may cause potential for electrical shock and damage to the appliance. If not provided by the manufacturer as original equipment, to mount this plug/cord on an existing appliance may void a warranty (for equipment with a warranty). Even if this plug were designed to replace the plug component of an existing power cord (cutting off the plug and attaching the Flashlight Plug to the end of the power cable), the same hazards and shortcomings as mentioned above may still apply. For appliances using a wall mount transformer, this plug/cord, or plug only, is of no practical use. While this plug may be a useful device for a manufacturer to install as original equipment on electrical appliances, it has very limited use as a replacement cord or plug on the vast majority of existing appliances. Additionally, once the Flashlight Plug is installed onto an appliance, it becomes a semi-permanent component of that appliance and cannot easily be unattached for use on other electrical devices.

U.S. Pat. No. 7,004,595 B1 (2004) to Stoddard discloses the ideal lighted plug adapter but offers a limitation in manufacturing terms. The replaceable battery/power source disclosed in the patent prescribes the need for a hatch or door which tremendously increases the cost of manufacturing. The present invention prescribes a disposable embodiment which will allow the user to more easily afford the adapter and still have a useful tool beyond the life of the battery.

U.S. patent application Ser. No. 11/354,330 with notice of allowance of claim 1 to Stoddard (2007) discloses an illuminating module that is attachable to an electrical transformer for the purpose of illuminating a receptacle. This is a useful product but it fails to reference the possibility of attachment to a plug adapter of any voltage or type.

It becomes apparent that a disposable illuminated adapter or adapter module for receptacle illumination, designed for temporary attachment to existing power plugs can be useful and provide substantial improvement over a non-disposable illuminated power cord or plug. No disposable, illuminated adapter or adapter modules designed for receptacle illumination could be found in the prior art.

OBJECTS AND ADVANTAGES

Several objects and advantages of the present invention are:

(a) to provide the Disposable Illuminated Electrical Plug Adapter using a light emitting diode as the light source;

(b) to provide the Disposable Illuminated Electrical Plug Adapter using a battery and switch to provide and control power to the light emitting diode;

(c) to provide the Disposable Illuminated Electrical Plug Adapter to project illumination towards the receptacle as well as towards the electrical plug that it is being attached to;

(d) to provide the Disposable Illuminated Electrical Plug Adapter in a manner that allows it to be manufactured affordably and without any serviceable parts;

(e) to design the Disposable Illuminated Electrical Adapter to effortlessly function on any and all types and voltages of electrical plugs be they audio, power, signal or other;

(e) to design the Disposable Illuminated Electrical Adapter to function as an effective marketing, advertising and awareness tool in conveying a marketable or significant message to the end user;

Still further objects and advantages will become apparent from a consideration of the ensuing description and drawings.

SUMMARY

In accordance with the present invention, my Disposable Illuminated Electrical Plug Adapter comprises a body, a light emitting diode, a power source, a switch, and electrical conductors fashioned to connect to and between an electrical receptacle and an electrical plug. So too does my Disposable Illuminated Adapter Module comprise a body, a light emitting diode, a power source, a switch and attachment means to attach to an electrical adapter.

DRAWINGS

Figures

Figure 11:
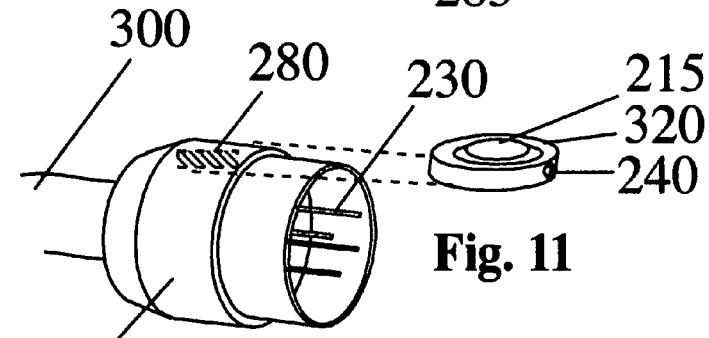

FIG. 11 presents a ¾ view of disposable adapter module and a typical audio/computer plug in a pre-attachment state.

Figure 12:
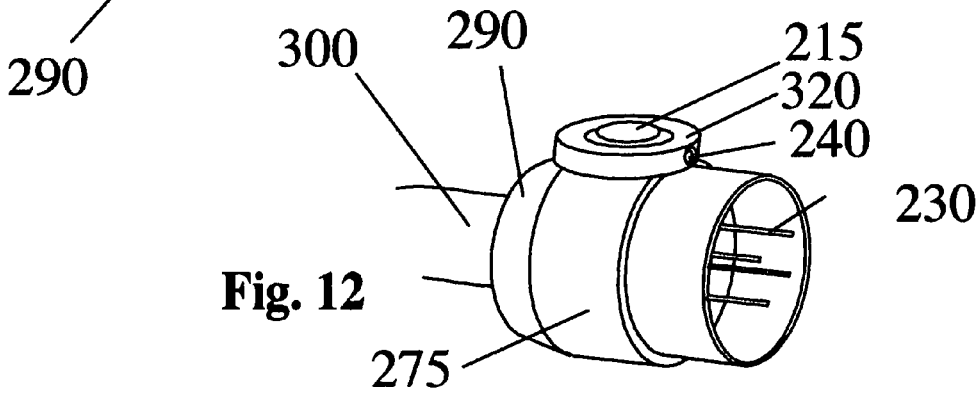

FIG. 12 is a perspective view of disposable adapter module removeably attached to a typical audio/computer type plug.

Figure 13:
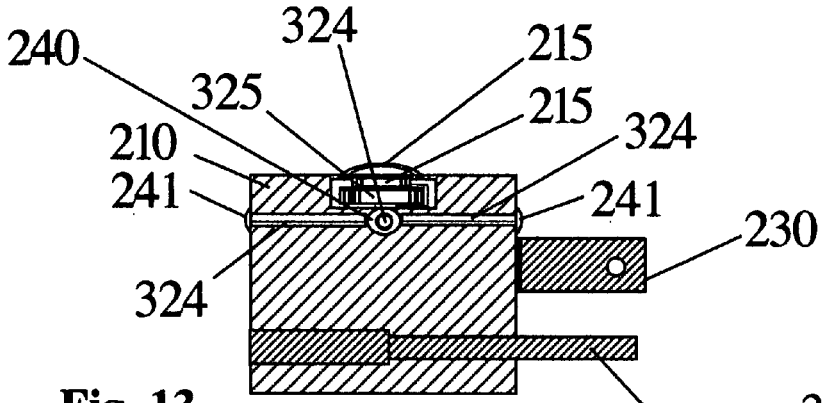

FIG. 13 Is a midline sectional view of the current invention, preferred embodiment.

Figure 14:
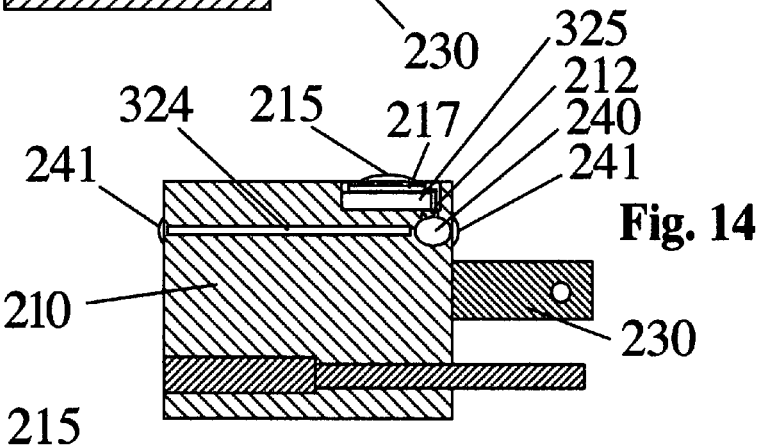

FIG. 14 is a midline sectional view of the current invention showing a variation of light source location and light transmission pathways in a preferred embodiment.

Figure 15:
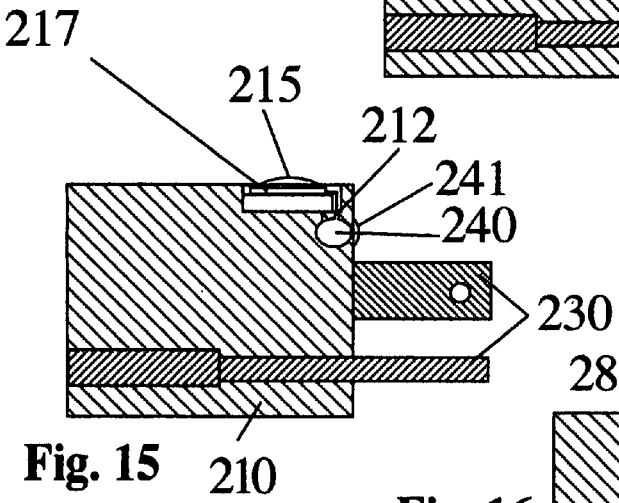

FIG. 15 is a midline sectional view of a single direction illumination embodiment.

Figure 16:
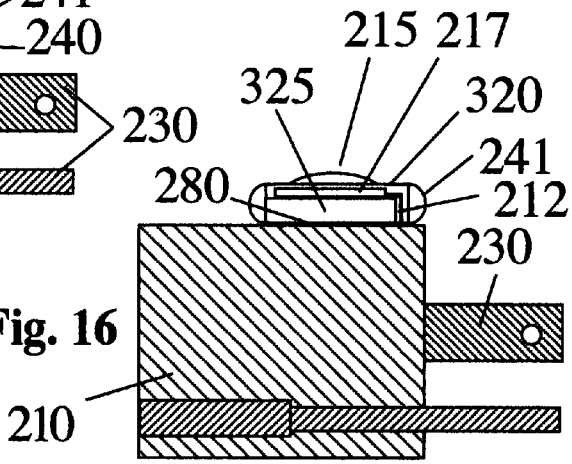

FIG. 16 is a midline sectional view of a disposable module equipped adaptor or plug.

DRAWINGS

Reference Numerals

| | |
|---|---|
| 205 | Disposable Illuminated Electrical Adapter |
| 210 | Disposable Illuminated Electrical Adapter Body |
| 212 | Encased electrical connections |
| 215 | Switch boot |
| 217 | Light source actuation switch |
| 220 | Electrical Receptacle |
| 230 | Electrical current conveyance means |
| 235 | Adapter openings accomodating electrical conveyance means |
| 240 | Light source |
| 241 | Diffusing lens |
| 245 | Disposable illuminated electrical adapter texture for grip |
| 246 | Disposable illuminated electrical adapter translucent body |
| 250 | Sound emitting orifices |
| 255 | Adapter body opaque advertising/marketing/informational image |
| 260 | Adapter body advertising/marketing/informational translucent image |
| 265 | Solar Panels for adapter power supply recharging |
| 275 | Disposable illumination module temporary attachment means |
| 280 | Disposable illumination module permenant attachment means |
| 285 | Electrical Plug power type |
| 290 | Electrical Plug audio/computer type |
| 300 | Electrical Plug wire, audio/computer type |
| 310 | Electrical Wire |
| 320 | Disposable illuminated electrical plug module |
| 324 | Disposable illuminated electrical adapter plug body light passage means |
| 325 | Power source |

DETAILED DESCRIPTION

Preferred Embodiment

For the purpose of promoting an understanding of the principles of the invention, reference will now be made to the embodiments illustrated in the drawings. Specific language will be used to describe same. It will, nevertheless, be understood that no limitation of the scope of the invention is thereby intended, such alterations and further modifications of the illustrated device, and such further applications of the principles of the invention as illustrated herein being contemplated as would normally occur to one skilled in the art to which the invention relates.

Certain terminology is used in the following description for convenience only and is not limiting. The word "user" is to mean a person using the disposable illuminated electrical plug adapter. The words "light source" are used throughout as a shortened term for "light emitting diode" and "light emitting diodes".

Figure 1:
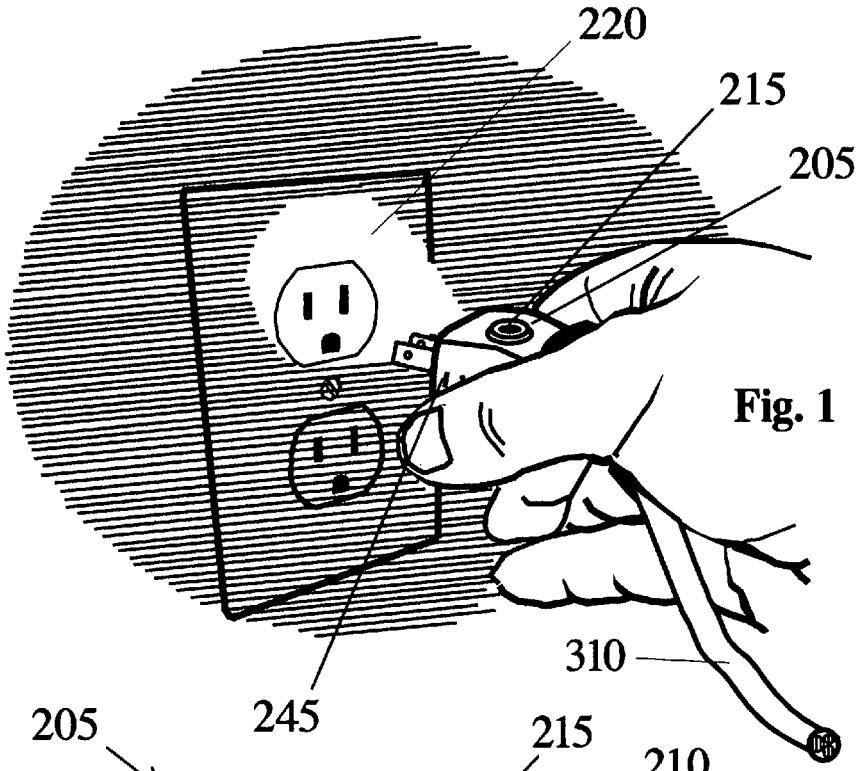
FIG. 1 is a perspective view of the present invention illustrating the intended function of providing this device to connect to an electrical power plug and cord in order to provide illumination onto an electrical receptacle.

FIG. 1 Shows the preferred embodiment of the invention, disposable illuminated electrical adapter 205 in use, being inserted into receptacle 220 while it is being illuminated by the light source, having been energized by the user depressing switch boot 215.

Figure 2:
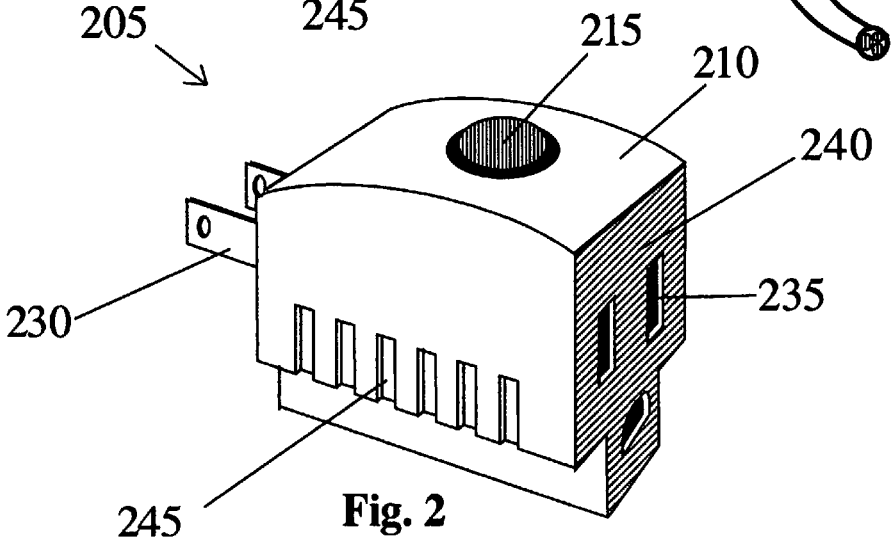
FIG. 2 is a rear, perspective view of the preferred embodiment of the present invention.

FIG. 2 Defines a rear perspective view of adapter 205 showing the body of adapter 210, Switch boot 215, electrical conveyance means 230, light diffusing lens 241 illuminating adapter openings for electrical conveyance means 235.

Figure 3:
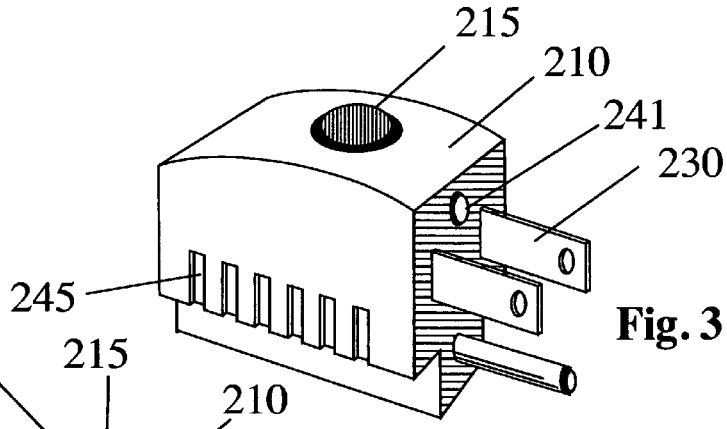
FIG. 3 is a front, perspective view of the preferred embodiment of the present invention.

FIG. 3 Provides a front perspective view of the preferred embodiment. Body texture for grip 245 facilitates safe insertion of electrical conveyance means 230 into a receptacle illuminated by light diffuser lens 241. Notice switch boot 215 built into adapter body 210.

Figure 4:
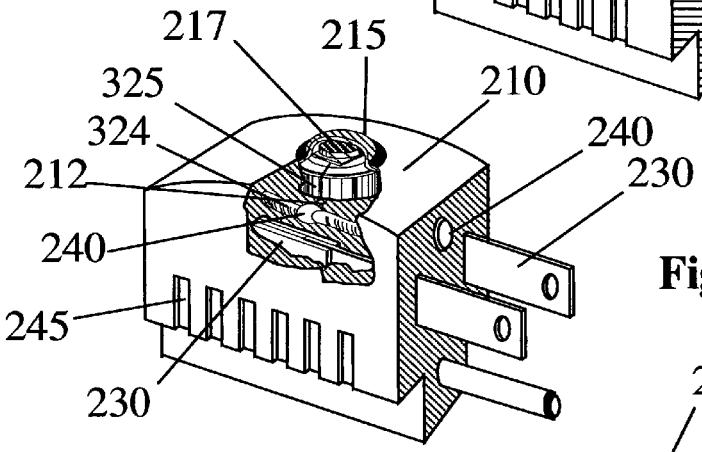
FIG. 4 is a cut away, front view of the preferred embodiment.

FIG. 4 Provides a front perspective, cut away view of the preferred embodiment where shown is the electrical switch 217 positioned beneath switch boot 215 and above disposable illuminated electrical adapter power supply 325. Encased electrical connections 212 supplying power to light source 240 permit light transmission fore and aft in adapter body 210 to light diffusing lenses 241 via translucent passages 324. Additionally is shown are electrical conveyance means 230 and adapter body texture for grip 245.

Figure 5:
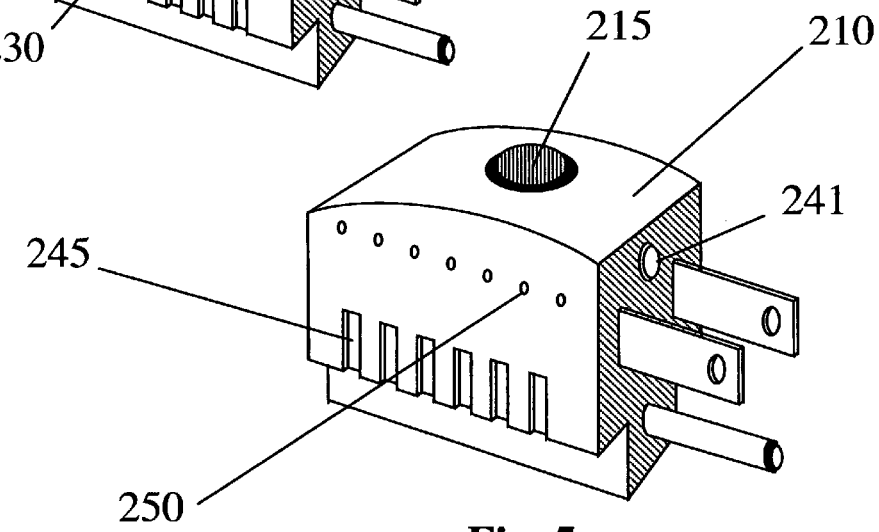
FIG. 5 is a front perspective view of another embodiment of the present invention.

FIG. 5 Provides a front perspective view of an additional embodiment. Body texture for grip 245 facilitates safe insertion of electrical conveyance means 230 into a receptacle illuminated by light diffuser lens 241. Notice switch boot 215 built into adapter body 210. Additional sound emitting orifices 250 are shown in approximation to internal electronic circuitry not shown.

Figure 6:
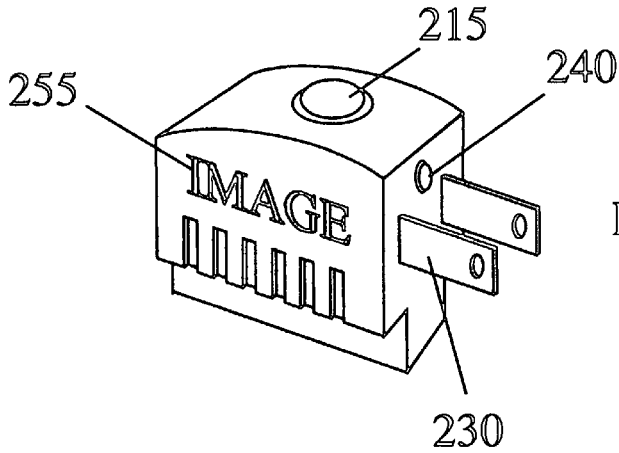
FIG. 6 is a front view of additional embodiment—safety or marketing message applied in an opaque, non illuminated capacity.

FIG. 6 Provides a front perspective view of an additional embodiment. Body texture for grip 245 facilitates safe insertion of electrical conveyance means 230 into a receptacle illuminated by light passing through light diffuser lens 241. Notice switch boot 215 built into adapter body 210. Additional features shown are opaque marketing image 255.

Additional Embodiments

Figure 7:
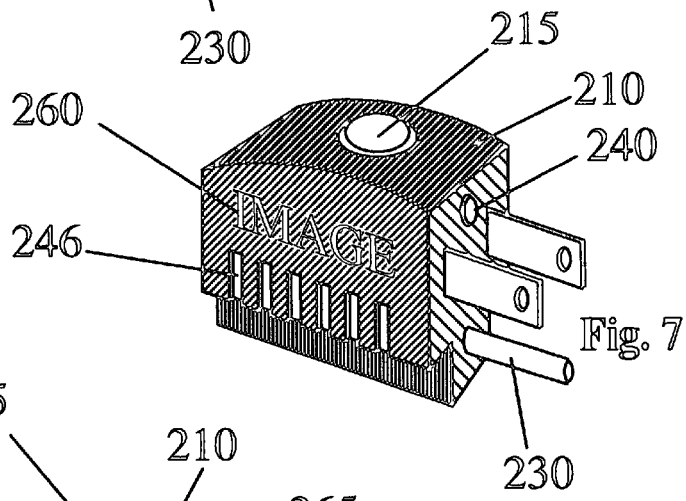
FIG. 7 is a front view of additional embodiment—safety or marketing message applied in a translucent, illuminated capacity.

FIG. 7 Provides a front perspective view of an additional embodiment. Body texture for grip 245 facilitates safe insertion of electrical conveyance means 230 into a receptacle illuminated by light passing through light diffuser lens 241. Notice switch boot 215 built into adapter body 210. Additional features shown are translucent marketing image 260 that are illuminated by various means including light passages or casting of adapter body with translucent material 246.

Figure 8:
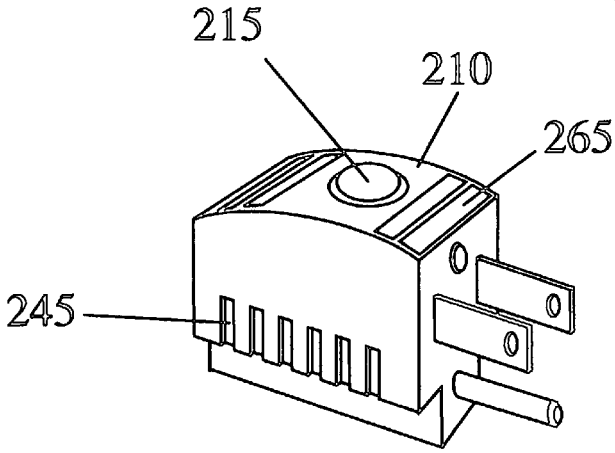
FIG. 8 is a front view of an additional embodiment.

FIG. 8 Provides a front perspective view of an additional embodiment. Body texture for grip 245 facilitates safe insertion of electrical conveyance means 230 into a receptacle illuminated by light passing through light diffuser lens 241.

Notice switch boot 215 built into adapter body 210. Additional features shown are solar charging cells 265.

Figure 9:
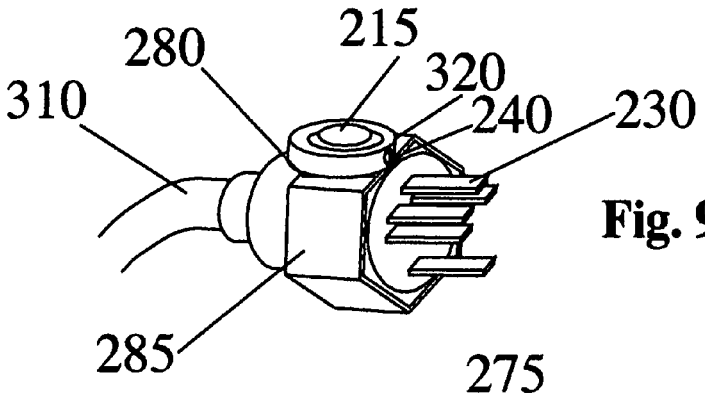
FIG. 9 is a front perspective view of illuminating adapter module installed on a typical electrical plug in a semi-permanent manner.

FIG. 9 Provides a front perspective view of an additional embodiment. Electrical plug 285 is shown attached to electrical cable 310. Disposable illuminated receptacle illumination module 320 with electrical switch boot 215 and light source 240 are shown permanently attached to electrical plug with adhesive 280.

Figure 10:
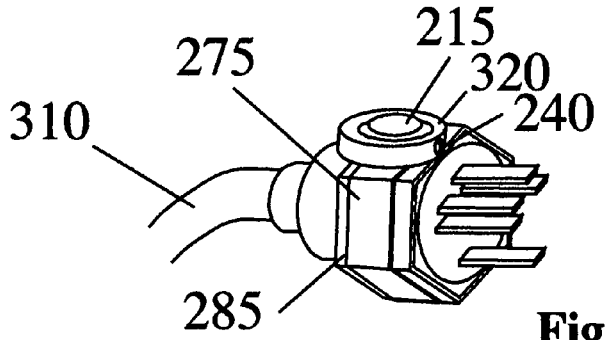
FIG. 10 is a front perspective view of illuminating adapter module installed on a typical electrical plug in an alternative manner.

FIG. 10 Provides a front perspective view of an additional embodiment. Electrical plug 285 is shown attached to electrical cable 310. Disposable receptacle illumination module 320 with electrical switch boot 215 and light source 240 are shown temporarily attached to electrical plug with band 275.

FIG. 11 Provides a front perspective view of an addition embodiment. Audio/computer type electrical plug 290 attached to electrical cable 300 is shown being permanently attached via adhesive panel 280 to disposable illuminated electrical plug module 320. Additionally shown is switch boot 215 and light source 240.

FIG. 12 Provides a front perspective view of an addition embodiment. Audio/computer type electrical plug 290 attached to electrical cable 300 is shown being temporarily attached via temporary attachment means 275 to disposable illuminated electrical plug module 320. Additionally shown is switch boot 215 and light source 240.

FIG. 13 Presents a midline, sectioned, sideview revealing Switch boot 215 above and protecting electrical switch 217 which is adjacent to and electrically connected via encased electrical connectors 212 to power supply 325 and light source 240. Light from light source 240 travels through passages 324 to diffusing lenses 241. Additional items shown are Disposable illuminated electrical adapter body 210 and electrical conveyance means 230.

FIG. 14 Presents a midline, sectioned, sideview revealing switch boot 215 above and protecting electrical switch 217 which is adjacent to and electrically connected via encased electrical connectors 212 to power supply 325 and light source 240. Light from light source 240 travels through passages 324 to diffusing lenses 241. Additional items shown are Disposable illuminated electrical adapter body 210 and electrical conveyance means 230.

FIG. 15 Presents a midline, sectioned sideview revealing Switch boot 215 above and protecting electrical switch 217 which is adjacent to and electrically connected via encased electrical connectors 212 to power supply 325 and light source 240. Additional items shown are Disposable illuminated electrical adapter body 210 and electrical conveyance means 230.

FIG. 16 Presents a midline, sectioned, sideview revealing disposable illuminated electrical plug module 320 attached to adapter body 210 with permanent adhesive 280. Additionally shown is switch boot 215, switch 217, power source 325, diffusing lenses 240 and electrical conveyance means 230.

Operation of Preferred Embodiment and Additional Embodiments

As illustrated in FIG. 1, the operation of this device is quite fundamental. The user, by depressing switch boot 215 will energise the light source and in so doing, illuminate a receptacle to facilitate a safe and complete insertion of the adapter.

FIG. 13 illustrates the presence of 2 count sources of illumination 241. With this embodiment, the insertion of the electrical plug's electrical conveyance means 230 into the illuminated adapter openings 235 (FIG. 2) are illuminated as well as the insertion of the adapter into the receptacle 220 (FIG. 1).

Additional useful advantages are presented in both FIGS. 6 and 7 in that Marketing logos, images, slogans and safety messages 255 can be applied to the side of the adapter body 210 in one of several ways. FIG. 6 presents an opaque image 255 printed, decaled or cast into or onto the adapter body 210. Image visibility will only occur with external lighting of some sort be it sunlight or ambient room lighting. FIG. 7 presents a more effective form of information presentation in that the image can be negatively printed on a clear adapter body 246 (FIG. 7) with a light source 240 imbedded within adapter body 210 or light passages 324 FIGS. 13 and 14 can be made to fortify the images with light.

Depending on the users message conveyance objectives, the addition of sound can be facilitated by sound emitting orifices 250 (FIG. 5). Utilizing known and universally accepted and affordable sound generating electronics imbedded in the body of the adapter, a message of safety or advertising could be easily conveyed to the user at any time the adapter 205 is in use.

The addition of the solar recharging panels 265 (FIG. 8) could easily lengthen the useful life of the illuminated electrical adapter power source 325. Conventional and established electronics could be imbedded adjacent to encased electrical connections 212 (FIGS. 4) and (13-16).

Advantages:

From the description above, a number of advantages of my disposable illuminated electrical plug adapter become evident:

(a) Use of the disposable electrical adapter provides a directed light source, clearly illuminating both the intended electrical receptacle as well as the electrical plug/wire assembly that is insertable into the adapter.

(b) the present invention combines the features of separate devices (electrical adapters and portable lighting) into one device. Combined, these features offer a higher level of safety and convenience. An example of this would be the ability to locate and illuminate a receptacle in a darkened area using just the Disposable Illuminated Electrical Plug Adapter.

(c) Effective marketing and branding opportunities abound with this useful product as auditory and visual media can be employed to aesthetically communicate with end user.

(d) The Disposable Receptacle Illuminating Module uses a low power light emitting diode so the power source will have a long run-time. When the power source is out of power, the adapter will still function as a non-illuminating adapter for a very long time, (e) The Disposable Illuminated Electrical Plug adapter can utilize a solar recharging circuit that will keep the battery recharged, enabling very long battery life. Situations where battery life may be shortened by constant use can benefit from use of this configuration.

(f) The disposable nature of the current invention affords a very reasonable cost to tooling and manufacturing. This affordability can be extended to the consumer.

CONCLUSION, RAMIFICATIONS, AND SCOPE

Accordingly, the reader will see that compared to using a standard plug or adapter, my disposable Illuminated electrical plug adapter can provide a user with an unobtrusive and inexpensive means to more safely and easily perform this very common, everyday task of plugging an electrical device into a receptacle. Furthermore, my disposable Illuminated Electrical Plug adapter provides additional advantages in that:

(a) The present invention enables user to easily locate receptacles in dark environments;

(b) The present invention is designed to be used with all electrical plugs and voltages including audio, computer and conventional electrical cord/plugs thereby allowing use of the adapter on any device having a corresponding electrical plug.

(c) The illuminating module is disposable and affordable.

(d) The present invention and additional embodiments enable user to provide to a variety of electrical plugs an affordable, temporary, and quick conversion from non-illuminated to illuminated.

Although the description above contains many specificities, these should not be construed as limiting the scope of the invention but as merely providing illustrations of some of the presently preferred embodiments.

Thus the scope of the invention should be determined by the appended claims and their legal equivalents, rather than by the examples given.

I claim:

1. A receptacle illuminating an electrical plug adapter comprising:

a body;

means for electrical power conveyance;

at least one light source;

at least one power source;

means for light conveyance; and enabling means to control electrical power from said power source to said light source;

wherein said body of the electrical plug adapter contains said means for electrical power conveyance and means for light conveyance and permanently contains said light source, said power source, and said enabling means to control electrical power from said power source to said light source, whereby a user may attach said illuminating electrical plug adapter to an electrical plug or a plug equipped device for a purpose of illuminating said means for light conveyance and an electrical receptacle.

2. The illuminating electrical adapter of claim 1, wherein quantity, voltage and amp rating of said means for power conveyance means are available.

3. The illuminating electrical adapter of claim 1, wherein said enabling means to control said power source to said light source is push on and release off or push off.

4. The illuminating electrical adapter of claim 1, wherein said enabling means to control said power source to said light source is push on and timed delay off.

5. The illuminating electrical adapter of claim 1, wherein said enabling means to control said power source to said light source is use proximity activated by a user grasps said adapter body.

* * * * *